US006055832A

United States Patent [19]

Wyers

[11] Patent Number: 6,055,832

[45] Date of Patent: May 2, 2000

[54] LOCKING DEVICE

[76] Inventor: Philip W. Wyers, 6476 S. Ivy Ct., Englewood, Colo. 80111

[21] Appl. No.: 09/153,511

[22] Filed: Sep. 15, 1998

Related U.S. Application Data

[60] Provisional application No. 60/058,955, Sep. 16, 1997.

[51] Int. Cl.[7] ..... E05B 67/36

[52] U.S. Cl. ..... 70/34; 70/18; 70/258

[58] Field of Search ..... 70/14, 18, 58, 70/49, 34, 57, DIG. 62, 258, 379–381

[56] References Cited

U.S. PATENT DOCUMENTS

| | | | |
|---|---|---|---|
| 2,677,261 | 5/1954 | Jacobi . | |
| 3,798,934 | 3/1974 | Wright et al. | 70/49 |
| 4,236,395 | 12/1980 | Avaiusini | 70/34 |
| 4,576,021 | 3/1986 | Holden | 70/34 |
| 4,619,122 | 10/1986 | Simpson | 70/34 |
| 4,637,234 | 1/1987 | Mielonen | 70/DIG. 62 |
| 4,711,106 | 12/1987 | Johnson | 70/34 |
| 4,844,498 | 7/1989 | Kerins et al. | 70/34 |
| 5,063,763 | 11/1991 | Johnson | 70/58 |
| 5,284,038 | 2/1994 | Johnson | 70/232 |
| 5,540,065 | 7/1996 | Wyers | 70/34 |
| 5,664,445 | 9/1997 | Chang | 70/34 |
| 5,676,258 | 10/1997 | Leyden et al. | 70/14 |

FOREIGN PATENT DOCUMENTS

| | | | |
|---|---|---|---|
| 0415355 | 3/1991 | European Pat. Off. | 70/49 |
| 2425386 | 12/1975 | Germany | 70/34 |
| 2248650 | 4/1992 | United Kingdom | 70/34 |

*Primary Examiner*—Damell M. Boucher
*Attorney, Agent, or Firm*—Timothy J. Martin; Michael R. Henson; Mark H. Weygandt

[57] ABSTRACT

A locking device includes a shackle member and a key operable locking head that may be fastened onto a latch portion of the shackle member. The locking head has a housing and a rotatable retainer and a lock core in the interior of the housing. The lock core is mechanically coupled to the retainer, and both the retainer and the lock core are axially oriented with respect to an axial opening in the housing. The latch portion is axially insertable through the axial opening when the lock core is in an unlocked state and has a latch head which becomes fastened by the locking head when the retainer is rotated by the lock core into a locked state. A seal is supported by the housing proximately to the axial opening and acts to seal against a seal surface on the latch portion. The shackle member can be a linear portion with a stop portion, such as a knob, or alternatively, a cable member. The latch portion preferably has both a first profile that engages the axial opening to prevent relative rotation of the shackle member and the locking head and a second profile that extends through an aperture in the retainer. The first and second profiles are geometrically similar. A limit stop prevents rotation of the retainer through more than a selected arc.

25 Claims, 4 Drawing Sheets

LOCKING DEVICE

This application claims the benefit of U.S. Provisional application Ser. No. 60/058,955, filed Sep. 16, 1997.

FIELD OF THE INVENTION

The present invention broadly relates to locking devices that are adapted to secure objects together. More particularly, the present invention concerns key operable locking devices. The invention specifically is directed to locking pins and cables that, for example, may be used for towage applications, bicycles and the like.

BACKGROUND OF THE INVENTION

Over the years, there have been numerous variations of locking devices for a multitude of applications. Typically, a locking device is used to secure objects together, whether it be two independent items, a door for an enclosure, or the like. Moreover, a wide variety of locking mechanisms have been employed, including key actuated locks and combination locks, all of various constructions.

A widely used locking device is known as a padlock. The prior art padlock works adequately for a number of conventional applications wherein the span of objects to be secured is relatively short or where the span can be fitted with a hasp. However, numerous short comings of padlocks become apparent when a padlock is sought to be used in applications wherein two objects of thick cross-sections are to be secured. Examples of such conventional applications include those where telescopically joined round or square tubing members need to be secured together. Another example is where perpendicular or axially cross-bolting of gates and doors require a substantially rod-like locking device.

As a result of the need for rod or elongated shackle locking devices, various devices have been developed to penetrate multiple surfaces having aligned through bores for the purpose of securing those objects together. Once such example is found in U.S. Pat. No. 2,677,261 issued May 1954 to Jacobi. The Jacobi patent, a complex locking device is taught in order to prevent actuation of a refrigerator door handle. Another example of a rod locking device is found in U.S. Pat. No. 4,576,021 issued Mar. 18, 1986 to Holden. Holden discloses a locking rod device having a rectangular locking head that is somewhat bulky and non-symmetrical. In the Holden locking device, a radially extendable locking pin engages a circumferential opening in the latch portion of the shackle in order to retain the shackle and locking head together. The bulky nature of this lock head design, however, makes it disadvantageous in use where only limited space is available. In addition, where the locking pin is spring loaded, the locking structure of Holden is prone to false locking, that is, the engagement of the locking head and shackle without an actual locked state occurring. Thus, the locking head may fall off during use.

Several additional types of straight shackle locks have been developed wherein the latched portion of the shackle is threadably received in a screw-type lock. Examples of these locks are described in U.S. Pat. No. 4,619,122 issued Oct. 28, 1986 to Simpson as well as in U.S. Pat. No. 4,711,106 issued Dec. 8, 1987 to Johnson. These types of locks, however, tend to be inconvenient and cumbersome to use due to the threaded nature of their locked mechanisms. Specifically, the key actuable locking head described in these two patents require a large number of key rotations in order to thread and fully secure the locking head portion onto the straight shackle. The inconvenience and difficulty of threaded lock systems is compounded when the lock is located in tight or difficult to access areas. Further, the threaded screw lock are especially prone to corrosion and seizure due to the small dimensioning of the threads.

The majority of the locking structures described in the prior art fail to employ suitable seals or other structures, such as caps or protective devices to limit access of unwanted substances such as dirt and moisture into the keyway or into the locking region. In U.S. Pat. No. 5,664,445 issued Sep. 9, 1997 to Chang, a sealing ring is provided on the shackle latch portion. While the Chang patent does address the importance of limiting the access of dirt and moisture into the locked mechanism, the solution offered in the Chang patent has some drawbacks. Due to the location of the seal on the end portion of the shackle, the seal is completely exposed. Since it is of larger diameter than the shank of the shackle, the slidable engagement of the shackle through aligned bores of two objects exposes the oversized diameter of the seal to attack by the rough edges or other sharp corners of the bores due to its oversized diameter. Thus, the seal can become damaged due to the snagging or rubbing of the seal against the aligned holes.

Accordingly, there remains a need for improved locking structures of a rod or cable type nature which can effectively lock objects together. There is a need for such locking mechanisms to have suitable seals and protective structures to prevent ingress of unwanted substances, such as dirt and moisture, into the locking mechanism. There is a further need for locking structures that reduce the tendency for false locking conditions.

SUMMARY OF THE INVENTION

It is an object of the present invention to provide a new and useful locking device that is simple in construction yet which provides a strong mechanical construction.

It is another object of the present invention to provide a locking structure particularly useful for rod and cable locking devices.

Another object of the present invention is to provide a locking device that has suitable seals that are located to seal the locking mechanism against foreign substances while reducing wear to the seals.

Yet another object of the present invention is to provide a key actuable locking device that reduces the likelihood of false locking.

Still a further object of the present invention is to provide a bolt-type locking structure having a pleasing, symmetrical appearance.

According to the present invention, then, a locking device is provided which is adapted to secure objects together. In its broad form, this locking device includes a key operable locking head and a shackle member that has a latch portion to be fastened by the locking head. The locking head thus includes a housing having an axial opening into an interior thereof, a rotatable retainer disposed in the housing and a lock core disposed in the housing and axially oriented with respect to the opening. The retainer has an aperture which aligns axially with the opening with the lock core being mechanically coupled to the retainer so that rotation of the lock core mechanism causes rotation of the retainer between a locked and unlocked state. The lock core has an axial keyway so that it is adapted to receive a key which may then be moved to rotate the lock core to drive the retainer.

The latch portion of the shackle member is thus configured to engage the locking head to prevent relative rotation therebetween. The latch portion includes a latch head that is configured to extend through the aperture of the retainer when the locking head is in the unlocked state yet which is configured to prevent withdrawal from the aperture when the retainer is rotated to the locked state. In this manner, the latch portion is captured by the locking head to be fastened therein.

The shackle member may be constructed to have a linear portion that is provided with a stop portion at a first end thereof with the latch portion then being disposed at a second end of the linear portion opposite the first end. Here, the stop portion may be formed as an enlarged knob, and it is preferred that the knob and the housing be formed to have a similar shape so that the shackle member and the locking head present a substantially symmetrical appearance when fastened together. The knob and the housing can be frusto-conical in shape having oppositely projecting convergent side surfaces. Alternatively, the shackle member can include a flexible cable portion to form a cable lock.

The housing also preferably includes a seal located proximately to the axial opening therein. In such case, the latch portion includes a seal surface with the seal and seal surface operative to engage one another when the locking head is in the fastened state to prevent ingress of unwanted substances through the axial opening and into the interior of the housing. In the preferred structure, the housing has an interior side wall, and an annular groove is formed in the interior side wall proximately to the axial opening. The seal is then annular O-ring disposed in the annular groove while the seal surface is a cylindrical section of the latch portion that is sized for close-fitted engagement with the O-ring. An optional cap element may be employed to engage an end of the housing opposite the axial opening and is sized and adapted to engage the end to cover the keyway.

In the preferred structure, the key is insertable into the keyway and then movable therefrom when the locking core is in the locked state. When it is rotated to the unlocked state, however, the key is captured in the keyway. To accomplish this, it is preferred that the locking core have an associated rotational limit so that a limit stop is provided to limit rotation of the retainer to less than 180°. Preferably, the rotational limit stop is operative to limit the rotation of the retainer to about 90°. Structurally, the rotational limit stop may be provided by a longitudinal post that is disposed in a peripheral channel formed in the retainer. The channel extends for slightly more than 90° of arc so that the retainer can rotate approximately 90°. Here, also, the lock core includes an axial plug that is rotated through and disposed in a rigid sleeve that is locked into the housing. The plug includes a centrally located, axially projecting drive cog that rotates in correspondence to the rotation of the plug by the key. The retainer includes a slot which mechanically couples with the drive cog so that rotation of the rotation of the drive cog rotates the retainer.

The retainer may take several constructions. In one embodiment, the retainer is a sleeve having a longitudinally projecting prong while a separate C-shaped washer has facing arm ends that define a gap therebetween. The prong is oriented to engage the gap both to form a rectangular aperture and to act to rotate the washer when the sleeve is rotated. The retainer can also be formed by a sleeve that has a pair of diametrically opposite, longitudinal prongs which engage corresponding diametrically opposite gaps in the peripheral edge of a washer. In this case, the aperture is formed centrally of the washer. Finally, the retainer may be one-piece construction that includes a pair of parallel plates joined together. Here, a first one of the plates has the aperture formed therein while a second one of the plates engages the lock core.

Returning again to the latch head, it preferably defines a first profile that has a first cross-section that is rectangular in shape having oppositely projecting lobes supported by a shank having a diameter that is approximately equal to the smaller width of the rectangle. The first cross-section is configured geometrically similarly to the aperture whereby the latch head may be inserted therethrough when the locking head is in the unlocked state. The latch portion may also include a second profile that has a second cross-section that is configured geometrically similarly to the axial opening. The second profile then engages the axial opening when in the mated state to prevent relative rotation of the housing in the latch portion. Preferably, the first and second profiles have a common cross-section and are aligned with one another. Here, the axial opening and the aperture have a common configuration and are aligned with one another when in the unlocked state but are skewed with respect to one another when in the locked state. The angle of skewing is then equal to the arc of rotation of the retainer.

These and other objects of the present invention will become more readily appreciated and understood from a consideration of the following detailed description of the exemplary embodiments when taken together with the accompanying drawings, in which:

BRIEF DESCRIPTION OF THE DRAWINGS

FIG. 9(*a*) is an end view in elevation of the key operable locking head of the locking device of FIG. 1, shown in an unlocked state;

FIG. 9(*b*) is an end view in elevation, similar to FIG. 9(*a*) but showing the key operable locking head in a locked state;

FIG. 10(*b*) is a cross-sectional view, similar to FIG. 10(*a*) but showing the key operable locking head and latch portion in a mated and locked state;

DETAILED DESCRIPTION OF THE EXEMPLARY EMBODIMENTS

The present invention is directed to a locking device that is adapted to secure objects together. The locking device broadly includes a key operable locking head that axially mates, through an axial opening thereof, with a shackle member. An axially insertable key rotates a locking core in the locking head in order to rotate a retainer that engages and releases a locking head on a latched portion of the shackle member. While the shackle member may take a variety of configurations, the present invention is particularly useful as a receiver lock that may be employed to secure a hitch bar to a receiver. However, the present invention may also be used as a coupler lock, as a watercraft lock, cross bolt gate lock, spare tire lock, bike carrier lock, a cable lock or any other similar locking structure.

Figure 1:
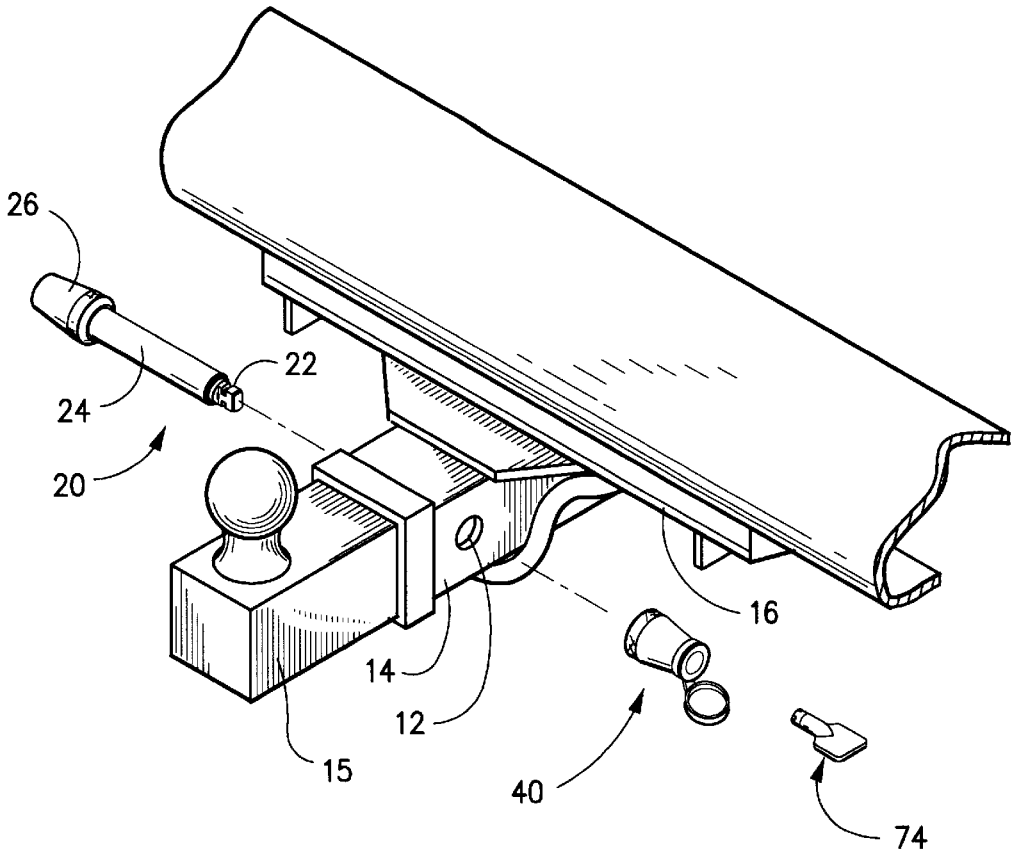
FIG. 1 is an exploded perspective view of a locking device according to a first exemplary embodiment of the invention to be used to lockably interconnect a draw bar to a trailer hitch receiver.
Figure 2:
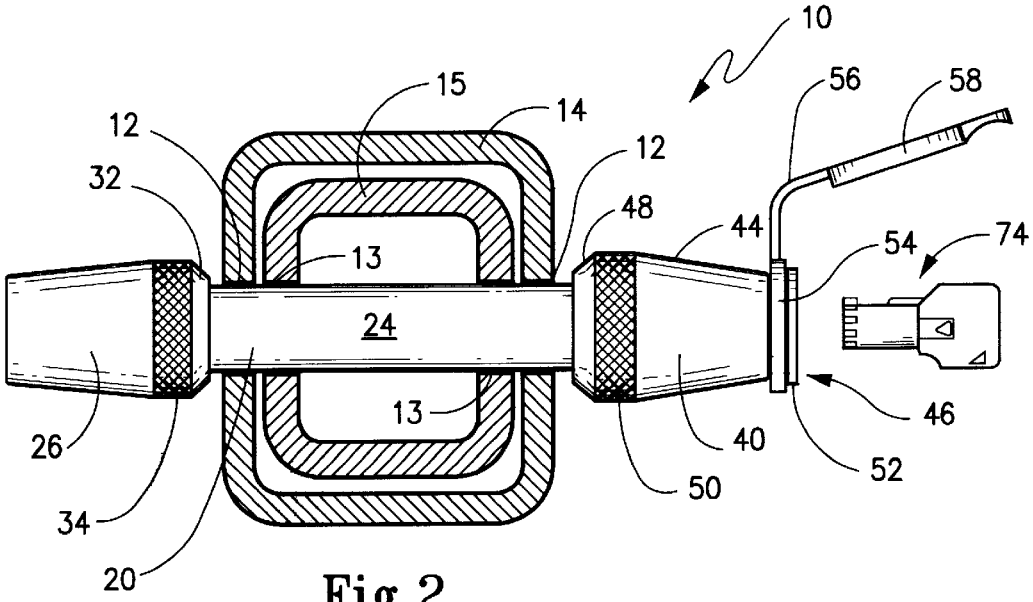
FIG. 2 is a side view in elevation of the locking device shown in FIG. 1, in a secured state, with the tow bar and trailer hitch receiver shown in cross-section.

A first exemplary embodiment of the present invention is shown in FIGS. 1–13, where like reference numbers refer to like parts. With reference first to FIGS. 1 and 2, it may be seen that locking device 10 includes a shackle member 20 and a key operable locking head 40 which may receive a latch portion 22 of shackle member 20 to define a fastened state, as is shown in FIG. 2. In FIGS. 1 and 2, locking device 10 is shown to be constructed as a receiver lock which may extend through the aligned bores 12 and 13 of a receiver 14 and a draw bar 15, respectively. Receiver 14, of course, is secured to a frame 16, for example, in the underside of a vehicle. It should be understood, however, that the description of the present locking device 10 is not intended to be limited to a receiver lock, with such construction being provided for illustration purposes only.

Figure 3:
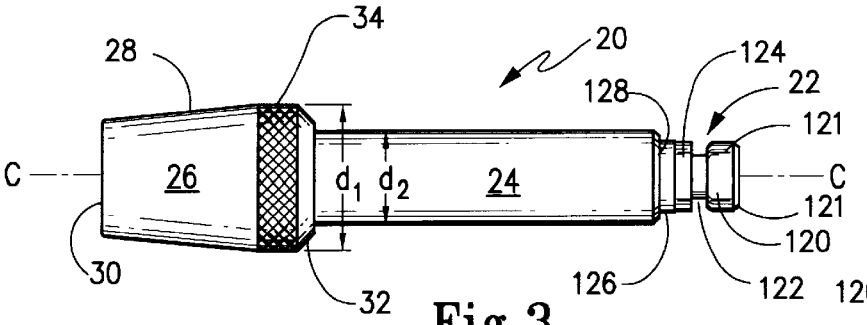
FIG. 3 is a side view in elevation of the shackle member of the locking device shown in FIGS. 1 and 2.
Figure 4:
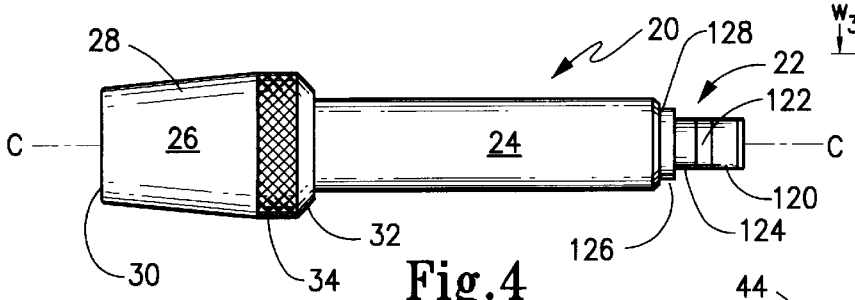
FIG. 4 is a top plan view of the shackle member shown in FIG. 3.
Figure 5:
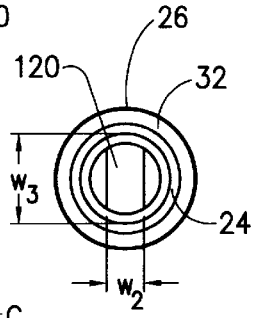
FIG. 5 is an end view in elevation of the shackle member shown in FIG. 3.
Figure 7:
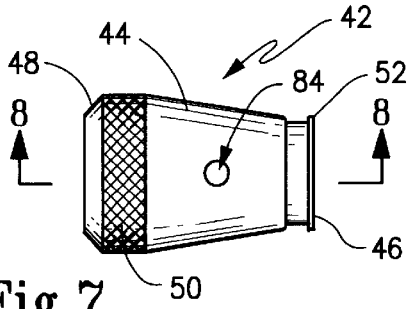
FIG. 7 is a top view in elevation of the housing for the key operable locking head of the locking device shown in FIG. 1.
Figure 6:
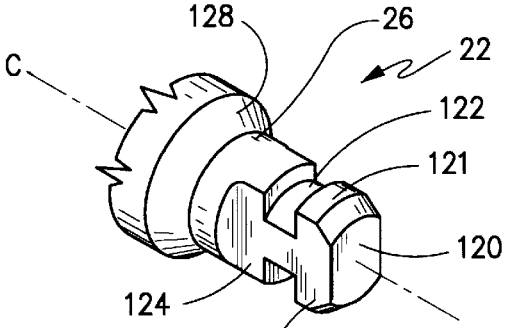
FIG. 6 is an enlarged perspective view showing the latch portion of the shackle member of FIGS. 3–5.
Figure 8:
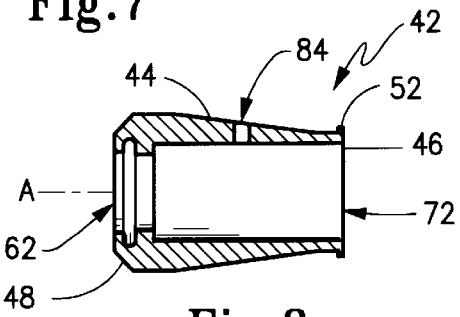
FIG. 8 is a cross-sectional view taken about lines 8—8 of FIG. 7.

With reference now to FIGS. 3, 4, 6 and 11, it may be seen that shackle member 20 includes an elongated linear portion 24 that has a central axis "C" that defines an elongate shaft. A stop portion 26 is disposed at a first end of linear portion 24 with latch portion 22 being disposed at a second end of linear portion 24 opposite the stop portion 26. Stop portion 26 is preferably formed as an enlarged knob that is frustoconical in shape, as is best shown in FIGS. 3 and 4. Accordingly, stop portion 26 is truncated having an outer side wall surface 28 that is outwardly convergent although truncated at its outer end to define a flat transverse surface 30. Stop portion 26 has a "$d_1$" that is larger than the diameter "$d_2$" of cylindrical linear portion 24. A frustoconical shoulder 32 forms an inner rim for stop portion 26 that is opposite transverse surface 30. Suitable knurling 34, if desired, may be formed on side wall surface 28 proximately to shoulder 32. Preferably, latch portion 22, linear portion 24 and stop portion 26 are formed as an integral one-piece construction, for example, a suitable forged steel. Alternatively, stop portion 26 may be suitably affixed to linear portion 24 in any convenient manner that is not readily removable should the integrity of locking device 10 be attacked.

Locking head 40 is best shown in FIGS. 2 and 7–10. Here, it may be seen that locking head 40 includes a housing 42 that is preferably formed to have a similar shape as stop portion 26 so that the shackle member and the locking head present a substantially symmetrical appearance when in the fastened state shown in FIG. 2. Accordingly, housing 42 is frustoconical in shape having an outer side wall surface 44 that is outwardly convergent to form a flat transverse truncation 46 at an outer rim thereof. A frustoconical shoulder 48 forms an inner rim, and knurling 50, if desired, may be formed on outer surface 44 proximately to shoulder 48. A radially projecting lip 52 may be provided to receive a plastic ring 54 that is secured by hinge piece 56 to a cap element 58 that clips over lip 52 in order to provide protection against environmental elements, as described in greater detail below.

Housing 42 includes a cylindrical interior 60 that has an axially opening 62 that is sized for insertion of latch portion 22 therethrough to define an engaged state. An annular groove 64 is formed around the interior of housing 42 adjacent to opening 62 with this groove operative to receive a seal in the form of an annular O-ring 66.

Interior 60 of housing 42 is also sized to receive a retainer 68 and a lock core 70 through an opening 72 that is opposite axial opening 62. Lock core 70 is thus disposed in housing 42 and is axially oriented along central axis "A" with respect to axial opening 62. Lock core 70 is of a standard construction known in the art that is key operable to be actuated by a tubular key 74 that may be inserted into a keyway 76 that is axially oriented with respect to lock core 70. As is known in the art, lock core 70 includes an outer sleeve 78 and an inner plug 80 which are relatively rotatable with respect to one another when unlocked by key 74. Thus, lock core 70 may be rotated between a locked state and an unlocked state when key 74 is inserted into keyway 76. Thus, it should be appreciated that key 74 may be inserted and removed from keyway 76 when lock core 70 is in the locked state. When key 74 rotates lock core 70 to the unlocked state, however, key 74 cannot be removed therefrom. In any event, lock core 70 may be affixed in the interior of housing 42 by means of a retaining pin 82 that extends through radial hole 84 in housing 42 and into a radial bore 86 in sleeve 78. Of course, lock core 70 can be mounted in any other convenient manner that resists removal.

Figures 9A, 9B, 11, 12, 13:
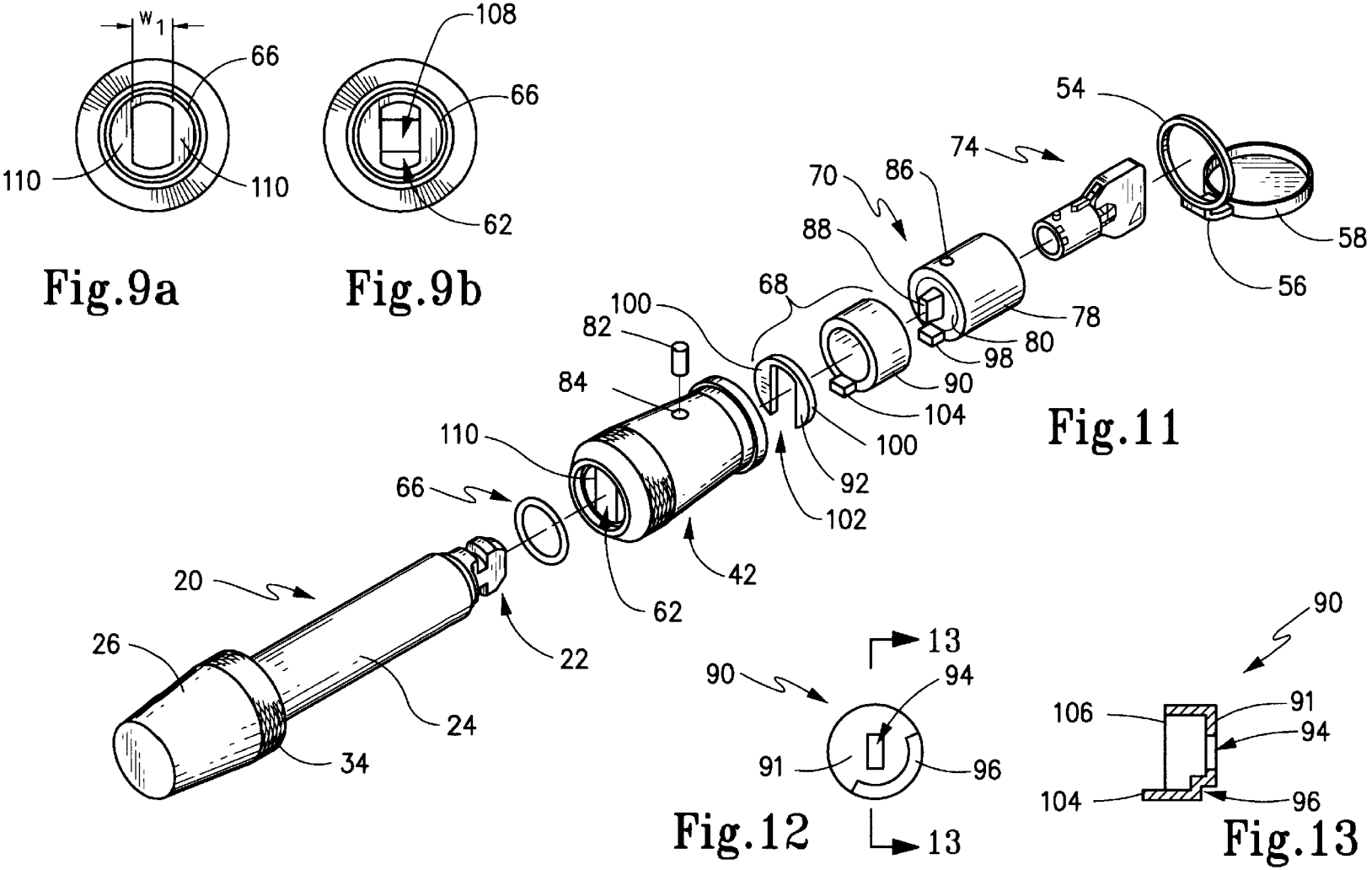
FIG. 11 is an exploded perspective view showing the assembly of the locking device according to the first exemplary embodiment of the present invention.
FIG. 12 is an end view in elevation of the rotatable retainer according to a first exemplary embodiment of the present invention.
FIG. 13 is a cross-sectional view taken about lines 13—13 of FIG. 12.

A centrally located, axially projecting drive cog 88 projects axially of plug 80 and rotates to define rotation of lock core 70. Drive cog 88 is operative to mechanically couple to retainer 68. Accordingly, rotation of lock core 70 causes rotation of retainer 68 between a locked state and an unlocked state. To this end, as is shown in FIGS. 11–13, retainer 68 may have a two-piece construction including a sleeve 90 and a C-shaped washer 92. Sleeve 90, as is shown in FIGS. 12 and 13, includes a slot 94 in an end wall 91 that is sized for engagement with drive cog 88. A peripheral channel 96 is formed circumferentially around one end of sleeve 90 and extends, preferably, for slightly more than 90° therearound. Channel 96 is sized to receive a longitudinal post 98 that extends from sleeve 78 of locking core 70 to provide a rotational limit stop for retainer 68. Preferably, the rotational limit stop associated with the lock core is operative to limit rotation thereof to less than 180°, although the rotational limit stop is preferably operative to limit the rotation to about 90°. Accordingly, rotation of drive cog 88 acts to rotate sleeve 90 between the circumferential limits of channel 96 by virtue of the tracking of post 98 in channel 96. C-shaped washer 92 has a pair of parallel arms 100 that have free ends which define a gap 102 therebetween. Gap 102 is sized to engage a prong 104 that longitudinally extends from sleeve 90. Accordingly, C-shaped washer 92 seats on rim 106 of sleeve 90 to define a rectangular aperture 108 (FIG. 9(*b*)) for retainer 68.

Housing 42, as noted above, has an axial opening 62. With reference now to FIG. 11, it may be seen that axial opening 62 is preferably rectangular in configuration defined by a pair of inwardly projecting, opposed webs 110 so that opening 62 and aperture 108 have a common configuration. As is shown in FIG. 9(*a*), when the retainer is in the unlocked state, opening 62 and aperture 108 are axially aligned with one another. However, when retainer 68 is moved to the locked state, as is shown in FIG. 9(*b*), aperture 108 and opening 62 are skewed with respect to one another, preferably by 90°.

The construction of latch portion 22 may now be appreciated in greater detail with an understanding of the construction of locking head 40. With reference again to FIGS. 3–6, it may be seen that latch portion 22 includes a latch head 120 configured for insertion through opening 62 and aperture 108 that is defined by prong 104 and C-shaped washer 92. Thus, latch head 120 defines a first profile that has a cross-section that is configured geometrically similar to, but slightly smaller than, aperture 108. Latch head 120 accordingly has oppositely projecting radial lobes 121 and is supported by means of a cylindrical shank 122 that has a diameter that is slightly smaller than the width "$w_1$" of both opening 62 and aperture 108. Latch head 120 has a first transverse width "$w_2$" that is equal to "$w_1$", but latch head 120 has a second transverse width "$w_3$" that is perpendicular to the first transverse width "$w_3$" being greater than "$w_1$". Accordingly, when latch portion 22 is in the mated state, retainer 68 may be rotated so that webs 100 rotate around shank 122 to prevent withdrawal of latch head 120 from aperture 108 thereby capturing latch portion 22 in locking head 40.

In order to prevent relative rotation between latch portion 22 and locking head 40, latch portion 22 is also preferably provided with a second profile 124 that has a cross-section that is configured geometrically similar, but slightly smaller, than axial opening 62. Second profile 124 is positioned to engage axial opening 62 when latch portion 22 is in the mated state thereby to prevent relative rotation of housing 42 and latch portion 22. Accordingly, it may be appreciated that latch head 120 is spaced sufficiently from second profile 124 so that retainer 68 may be rotated between the locked and unlocked states. Moreover, latch portion 22 includes a cylindrical surface 126 that forms a seal surface adjacent a seat 128 that is operative to engage annular O-ring 66 to prevent ingress of unwanted substances through opening 62 and into the interior 60 of housing 42 when locking head 40 is mated with latch portion 22 of shackle member 20. Thus, seal surface 126 is a cylindrical section of latch portion 22 that is adjacent linear portion 24.

Figure 10A:
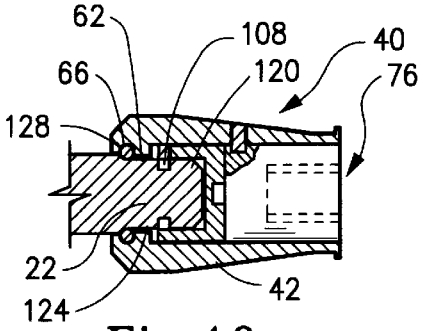
FIG. 10(*a*) is a side view in cross-section showing the key operable locking head engaging the latch portion of the shackle member in a mated but unlocked state.
Figure 10B:
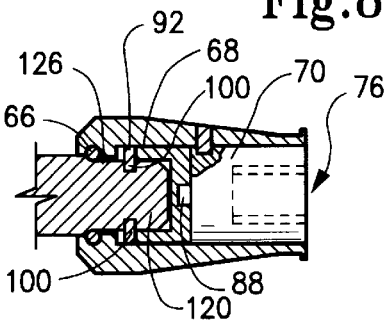

The interaction and operation of locking head 40 and latch portion 22 may now be appreciated with reference to FIGS. 10(*a*) and 10(*b*). In FIG. 10(*a*), it may be seen that latch portion 22 is an in engaged state with locking head 40, with locking head 40 in the unlocked state. Here, latch portion 22 is matably inserted through axial opening 62 so that second profile 124 interlocks with opening 62 to prevent relative rotation of latch portion 22 in housing 42. Annular O-ring 66 engages seat 128 of seal surface 126. Latch head 120 thus extends through aperture 108 with washer 92 being radially registered with shank 122.

When lock core 70 is rotated to the locked state, shown in FIG. 10(*b*), retainer 68 is rotated so that opening 62 and aperture 108 are skewed with respect to one another (FIG. 9(*b*)), as noted above. When this occurs, arms 100 of retainer 68 are rotated to engage lobes 121 so that latch head 120 cannot be removed from locking head 40. Key 74 may then be removed from locking head 40 with locking device 10 interconnecting the desired objects. Cap piece 58 may be fastened onto lip 52 so that O-ring seal 66 and cap 58 substantially seal the interior locking head 40 during use.

Figure 14:
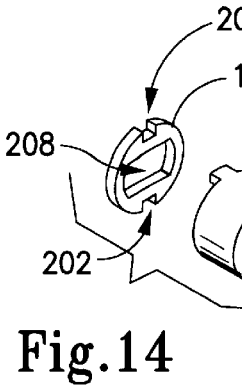
FIG. 14 is a left perspective view of a second exemplary embodiment of a rotatable retainer according to the present invention.
Figure 15:
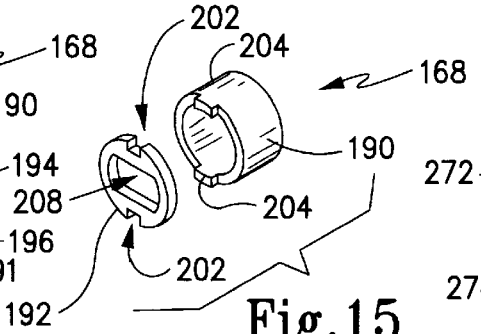
FIG. 15 is a right perspective view of a rotatable retainer of FIG. 14.

A first alternative embodiment of retainer 68 is shown in FIGS. 14 and 15. In these figures, retainer 168 is again shown as a two-piece construction. However, in these figures, sleeve 204 is provided with a pair of diametrically opposite longitudinally extending prongs 204 which engage a pair of diametrically opposite gaps 202 formed in the peripheral edge of a washer 192. Washer 192 has an aperture 208 formed centrally thereof to receive latch portion 22, as described above. Here again, sleeve 190 includes an end wall 191 that has a slot 194 sized to receive drive cog 188. Again a channel 196 is formed to receive post 98 to provide a limit stop for the relative rotation of retainer 168. The structure of retainer 168 has a the advantage of being slightly sturdier than retainer 68 due to the use of a circular washer 192 in place of C-shaped washer 192.

Figure 16:
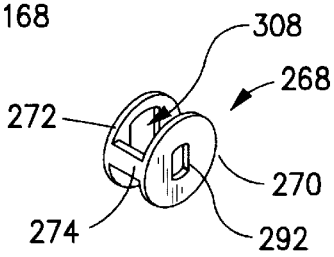
FIG. 16 is a front perspective view of a rotatable retainer according to a second alternative structure according to the present invention.
Figure 17:
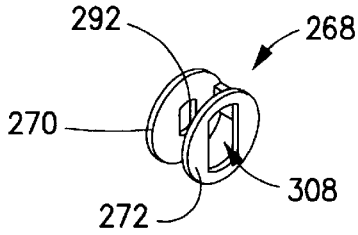
FIG. 17 is a rear perspective view of the rotatable retainer shown in FIG. 16.

A second alternative embodiment of the retainer is shown in FIGS. 16 and 17. Here, retainer 268 is of a one-piece construction. Retainer 268 includes a pair of parallel plates, including a first plate 270 and a second plate 272 that are joined together by means of longitudinal arm 274 formed integrally therewith. Plate 270 includes a slot 292 sized to receive drive cog 88. Plate 272 is provided with a central aperture 308 sized to receive latch head 120 of latch portion 122. Retainer 268 has the advantage of being a single piece construction to eliminate the independent sleeve 90 (or 190) and washer 92 (or 192).

Figure 18:
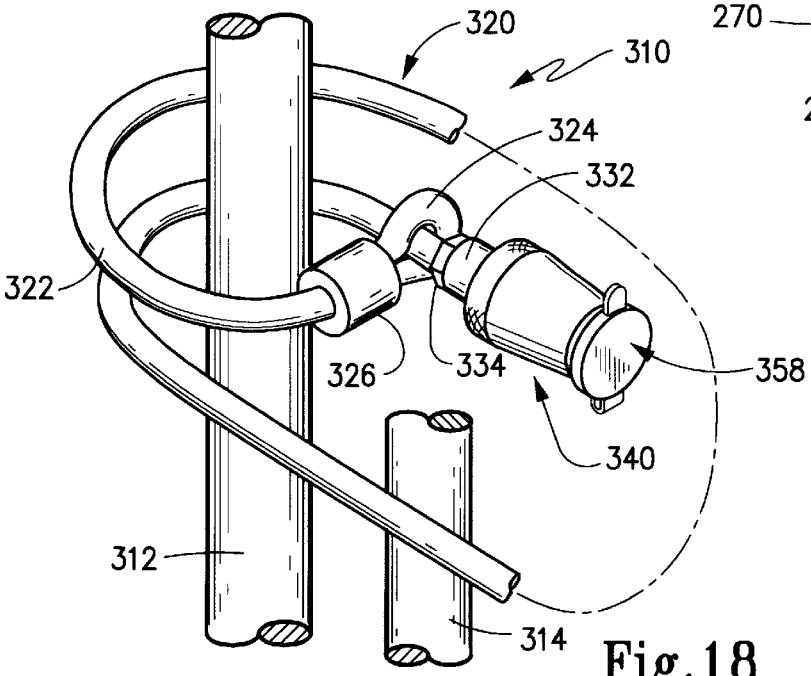
FIG. 18 is a perspective view of a second alternative embodiment of the present invention.

A second exemplary embodiment of latching device according to the present invention is shown in FIG. 18. Here, locking device 310 is in the form of a cable device having a shackle member 320 and a locking head 340. Locking head 340 is shown with cap element 358 secured thereto to prevent ingress of unwanted substances into the keyway. However, locking head 340 is structured identical to locking head 40 so that this construction is not repeated.

In any event, as is shown in FIG. 18, locking device 310 is adapted to secure two objects together such as two different frame pieces 312 and 314. Shackle portion 320 thus includes an elongated flexible cable 322 which may encircle the objects to be secured. Cable 322 has a loop 324 formed at a first end thereof with loop portion 324 secured by means of a clamp 326. A latch portion 332 is mounted at an end of cable 322 opposite loop 324. Latch portion 332 is secured on cable 322 by any suitable means such as clamps 334. The engaged part of latch portion 332 that is mated with locking head 340 is configured the same as latch portion 22 so, again, a description of this structure is not repeated. It should be appreciated, however, by the ordinarily skilled artisan that latch portion 332 may be inserted through loop 324 and thereafter locked into locking head 340, in the manner described above, so that cable 322 forms a secure, closed loop around the objects to be protected.

Figure 19:
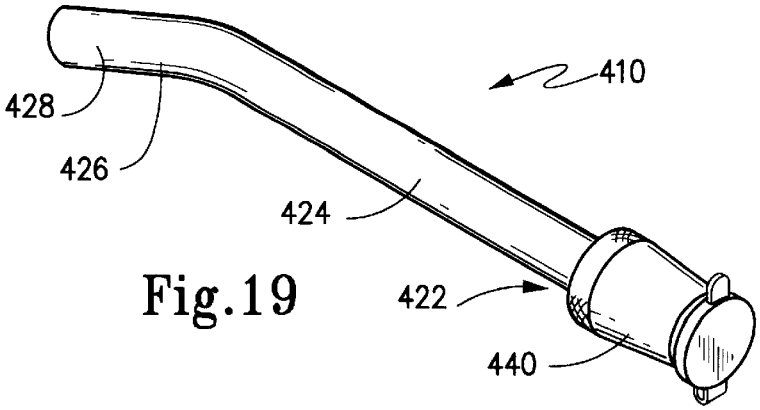
FIG. 19 is a perspective view of a third alternative embodiment of the present invention.

A third exemplary embodiment of the present invention is shown in FIG. 19. Here, locking device 410 has a shackle member 420 that includes a linear portion 424 that terminates at a second end in a latch portion 422 that is lockably engaged with a locking head 440. Here again, locking head 440 and latch portion 422 are constructed as described above. In the alternative embodiment shown in FIG. 19, however, shackle member 420 of locking device 410 has a first end formed with a stop portion that is different than stop portion 26. Whereas stop portion 26 was formed as an enlarged knob, stop portion 426 of shackle member 420 is formed by an angled foot 428 that is bent out of alignment with linear portion 420. The angled foot 428 thus acts as a stop to prevent passage of shackle device 420 completely through a pair of aligned bores, such as bores 12 and 13 of two objects.

From the foregoing, it should be appreciated that a variety of different constructions of locking devices are within the ambient of the present invention. For example, the diameter and length of linear portion 124 may be varied to suit the particular needs of a locking device. Thus, the locking devices according to the present invention may be used as receiver locks, coupler locks and the like. Indeed, virtually any type of shackle configuration is within the scope of the present invention so long as it has the axially insertable latch portion which will mate with the locking head. Moreover, different locking head constructions are possible while still providing the seal in the locking head to prevent the ingress of unwanted substances.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiment of the present invention without departing from the inventive concepts contained herein.

I claim:

1. A locking device, comprising:

(a) a key operable locking head movable between a locked state and an unlocked state and including:

(i) a housing having an axial opening and an interior;

(ii) a rotatable retainer disposed in said housing, said retainer having an aperture; and (iii) a lock core disposed in said housing and axially oriented with respect to the opening, said lock core mechanically coupled to said retainer and having a keyway adapted to receive a key whereby rotation of the key acts to rotate said lock core thereby causing rotation of said retainer to define the locked state and the unlocked state; and (b) a shackle member including a latch portion configured to engage for insertion into the locking head through the axial opening to define a mated state and configured to engage said locking head to prevent relative rotation therebetween, said latch portion including a latch head configured for insertion through the aperture of said retainer when said locking head is in the unlocked state yet configured to prevent withdrawal from said aperture when said retainer is rotated to the locked state whereby said latch portion is captured by said locking head to define a fastened state.

2. A locking device according to claim 1 wherein said shackle member includes a linear portion and a stop portion disposed at a first end of said linear portion, said latch portion being disposed at a second end of said linear portion opposite the first end.

3. A locking device according to claim 2 wherein said stop portion is formed as an enlarged knob.

4. A locking device according to claim 3 wherein said knob and said housing are formed to have a similar shape whereby said shackle member and said locking head present a substantially symmetrical appearance when in the fastened state.

5. A locking device according to claim 4 wherein said knob and said housing are frustoconical in shape with oppositely projecting convergent side surfaces.

6. A locking device according to claim 1 wherein said shackle member includes a flexible cable portion.

7. A locking device, comprising:

(a) a key operable locking head movable between a locked state and an unlocked state and including:

(i) a housing having an interior, an axial opening and a seal located proximately to said axial opening;

(ii) a rotatable retainer disposed in said housing said retainer having an aperture; and (iii) a lock core disposed in said housing and axially oriented with respect to the opening, said lock core mechanically coupled to said retainer and having a keyway adapted to receive a key whereby rotation of the key acts to rotate said lock core thereby causing rotation of said retainer to define the locked state and the unlocked state; and (b) a shackle member including a latch portion configured to engage for insertion into the locking head through the axial opening to define a mated state and configured to engage said locking head to prevent relative rotation therebetween, said latch portion including a latch head configured for insertion through the aperture of said retainer when said locking head is in the unlocked state yet configured to prevent withdrawal from said aperture when said retainer is rotated to the locked state whereby said latch portion is captured by said locking head to define a fastened state, said latch portion further including a seal surface which is engaged by said seal when said locking head is in the fastened state thereby to prevent ingress of unwanted substances through the axial opening and into the interior of said housing.

8. A locking device according to claim 7 wherein said housing has an interior side wall and wherein an annular groove is formed in the interior side wall proximately to the axial opening, said seal being an annular O-ring disposed in the annular groove and said seal surface being a cylindrical section on said latch portion sized for close-fitted engagement with said O-ring.

9. A locking device according to claim 7 including a cap element sized and adapted to engage an end of said housing opposite the axial opening to cover said keyway.

10. A locking device according to claim 1 including a rotational limit stop associated with said lock core and operative to limit rotation of said retainer to less than 180°.

11. A locking device according to claim 10 wherein said rotational limit stop is operative to limit rotation of said retainer to about 90°.

12. A locking device according to claim 10 wherein said lock core has a rigid sleeve and a rotatable axial plug disposed in said sleeve, said plug including a centrally located, axially projecting drive cog that rotates in correspondence to rotation of said plug, and which is operative to mechanically couple to said retainer whereby rotation of said drive cog acts to rotate said retainer, said rotational limit stop including a post that is rigidly disposed relative to said housing and a channel in said retainer that is sized and positioned to receive said post.

13. A locking device according to claim 1 wherein said latch head defines a first profile that has a first cross-section that is configured geometrically similar to the aperture whereby said latch head may be inserted therethrough when said locking head is in the unlocked state, said latch portion including a second profile that has a second cross-section that is configured geometrically similar to the axial opening, said second profile positioned to engage the axial opening when in the mated state thereby to prevent relative rotation of said housing and said latch portion, said latch head spaced from said second profile sufficiently so that said retainer may be rotated between the locked and unlocked states.

14. A locking device according to claim 12 wherein said first and second profiles are aligned with one another and have a common cross-section defined by opposite flattened side surfaces and oppositely projecting radial lobes extending between said flattened side surfaces and wherein the axial opening and the aperture have a common configuration and are aligned with one another when in the unlocked state yet are skewed with respect to one another when in the locked state.

15. A locking device according to claim 1 wherein said retainer includes a sleeve having a longitudinally projecting prong and a C-shaped washer that has facing arm ends that define a gap therebetween, said prong oriented to engage said gap whereby rotation of said sleeve acts to rotate said washer.

16. A locking device according to claim 1 wherein said retainer is a one-piece construction including two parallel plates joined together, a first one of said plates having the aperture formed therein and a second one of said plates engaging said lock core.

17. A locking device, comprising:

(a) a key operable locking head movable between a locked state and an unlocked state and including a housing having an opening and an interior, a retainer and a lock core disposed in said housing, said lock core mechanically coupled to said retainer and having a keyway adapted to receive a key whereby rotation of the key acts to rotate said lock core thereby moving said retainer to define the locked state and the unlocked state, said locking head including a seal disposed proximately to the opening in surrounding relation thereto; and (b) a shackle member including a latch portion configured for insertion into the locking head through the opening to define a mated state and configured to engage said locking head, said latch portion including a latch head operative to mate with said retainer when said locking head is in the unlocked state yet configured to prevent withdrawal from said locking head when said locking head is moved to the locked state whereby said latch portion is captured by said locking head to define a fastened state, said latch portion including a seal surface, said seal engaging said seal surface when said locking head is in the fastened state thereby to prevent ingress of unwanted substances through the opening and into the interior of said housing.

18. A locking device according to claim 17 wherein said shackle member includes a linear portion that has an enlarged knob disposed at a first end thereof with said latch portion disposed at a second end thereof opposite the first end.

19. A locking device according to claim 17 wherein said shackle member includes a flexible cable portion.

20. A locking device according to claim 7 wherein said housing has an interior side wall and wherein an annular groove is formed in the interior side wall proximately to the opening, said seal being an annular O-ring disposed in the annular groove and said seal surface being a cylindrical section on said latch portion sized for close-fitted engagement with said O-ring.

21. A locking device, comprising:

(a) a key operable locking head movable between a locked state and an unlocked state and including a housing having an axial opening and an interior, a rotatable retainer disposed in said housing and having an aperture, and a lock core disposed in said housing and axially oriented with respect to the opening, said lock core mechanically coupled to said retainer and having a keyway adapted to receive a key whereby rotation of the key acts to rotate said lock core thereby causing rotation of said retainer to define the locked state and the unlocked state, said housing includes a seal located proximately to the axial opening therein; and (b) a shackle member including a latch portion configured for insertion into the locking head through the axial opening to define a mated state and configured to engage said locking head to prevent relative rotation therebetween, said latch portion including a latch head having a first profile that has a first cross-section that is configured geometrically similar to the aperture whereby said latch head extends therethrough when said locking head is in the unlocked state, yet configured to prevent withdrawal from said aperture when said locking head is rotated to the locked state whereby said latch portion is captured by said locking head to define a fastened state, said latch portion including a second profile that has a second cross-section that is configured geometrically similar to the axial opening, said second profile positioned to engage the axial opening when in the mated state thereby to prevent relative rotation of said housing and said latch portion, said latch head spaced from said second profile sufficiently so that said retainer may be rotated between the locked and unlocked states, and said latch portion including a seal surface, said seal engaging said seal surface when said latch portion is in the mated state to prevent ingress of unwanted substances through the axial opening and into the interior of said housing.

22. A locking device according to claim 21 wherein said shackle member includes a linear portion that has a stop portion disposed at a first end thereof with said latch portion disposed at a second end thereof opposite the first end.

23. A locking device according to claim 21 wherein said shackle includes a flexible cable portion.

24. A locking device according to claim 21 including a rotational limit stop associated with said lock core and operative to limit rotation thereof to less than 180°.

25. A locking device according to claim 21 wherein said first and second profiles have a common cross-section and are aligned with one another, and wherein the axial opening and the aperture have a common configuration and are aligned with one another when in the unlocked state yet are skewed with respect to one another when in the locked state.

* * * * *